United States Patent [19]

Dinslage

[11] Patent Number: 4,836,418

[45] Date of Patent: Jun. 6, 1989

[54] BULK CONTAINER AND METHOD OF MANUFACTURING AND PREPARING SAME

[76] Inventor: Wilfried Dinslage, Mühlenstrasse 16, 5161 Merzenich, Fed. Rep. of Germany

[21] Appl. No.: 888,321

[22] PCT Filed: Nov. 5, 1985

[86] PCT No.: PCT/EP85/00590

§ 371 Date: Jul. 7, 1986

§ 102(e) Date: Jul. 7, 1986

[87] PCT Pub. No.: WO86/02910

PCT Pub. Date: May 22, 1986

[30] Foreign Application Priority Data

Nov. 5, 1984 [DE] Fed. Rep. of Germany ..... 3440367

[51] Int. Cl.[4] ..... B65D 35/56

[52] U.S. Cl. ..... 222/82; 222/105; 222/148; 137/240

[58] Field of Search ..... 222/105, 386.5, 152, 222/80–82, 148; 493/186, 189, 213, 218; 53/425, 426; 137/240, 246

[56] References Cited

U.S. PATENT DOCUMENTS

| | | | |
|---|---|---|---|
| 3,514,919 | 6/1970 | Ashton et al. | 53/425 |
| 3,643,679 | 2/1972 | Hansson | 137/241 |
| 4,245,760 | 1/1981 | Stevenson et al. | 137/240 X |
| 4,314,768 | 2/1982 | Goglio et al. | 222/105 X |
| 4,325,401 | 4/1982 | Ukai et al. | 137/240 |
| 4,421,253 | 12/1983 | Croley | 222/105 |
| 4,445,550 | 5/1984 | Davis et al. | 141/329 |
| 4,452,030 | 6/1984 | Inada | 53/426 |
| 4,520,948 | 6/1985 | Hampel et al. | 222/105 X |
| 4,636,391 | 1/1987 | Pike | 426/106 |

FOREIGN PATENT DOCUMENTS

| | | | |
|---|---|---|---|
| 895851 | 8/1983 | Belgium . | |
| 2908654 | 9/1980 | Fed. Rep. of Germany | 222/105 |
| 317629 | 9/1902 | France . | |
| 8200280 | 2/1982 | PCT Int'l Appl. . | |
| 2172663 | 9/1986 | United Kingdom | 222/105 |

*Primary Examiner*—Michael S. Huppert

*Attorney, Agent, or Firm*—Robert F. Ziems

[57] ABSTRACT

A package-type container for receiving a free-flowing product. The container including a foil-bag (2) composed of individual foil webs welded together which is placed in a rigid casing (1) and has a discharge device which provides sterile sealing with regard to the outside atmosphere. The discharge device including an outlet plug (4) which is firmly linked with the foil-bag, and an extraction device (5) which can be applied thereto.

14 Claims, 11 Drawing Sheets

BULK CONTAINER AND METHOD OF MANUFACTURING AND PREPARING SAME

The present invention is concerned with bulk containers intended to accommodate fluidizable products, and in particular with bulk containers intended for accommodating fluidizable products, having sizes of more than 200 liters capacity.

Owing to an increasing rationalization in all industrial fields, products are packed and transported in increasingly large units. However, this trend to accept larger-sized units not only is hampered by the fact that the manufacture of large-sized containers is liable to involve difficulties, but also by the problem occurring at the receiving end, residing in that the product supplied in a large container, in accordance with the requirements at the receiving end, will have to be discharged for weeks on end. However, in respect of delicate organic products, such as foodstuffs, the discharge dragging on for weeks involves the risk that the product at least in part is bacterially decomposed, hence, becoming unfit for human consumption.

It is the object of the present invention to provide a bulk container appropriate for fluidizable products which is easy to manufacture and prepare, envolving low manufacturing costs, and which exhibits a strength appropriate for transportation, permitting a substantially complete discharge of the product and safeguarding that also delicate organic products, such as foodstuffs, can be dispensed for weeks on end without affecting the product quality.

In the practice of the invention, this is achieved in that a foil bag is provided, sealed together from individual foil webs, with the foil bag being accommodated in rigid envelope and comprising a loading opening and an outlet means disposed in the bottom part of the foil bag and aseptically sealing the foil bag against the environment, with the outlet means penetrating the envelope and comprising a draining tongue rigidly connected to the foil bag, and a discharge mechanism mountable thereon.

The bulk container as suggested by the invention enables a major amount of a foodstuff to be dispensed in partial amounts for weeks on end with no risk to the foodstuff in the container to be spoilt, thereby permitting foodstuffs to be withdrawn and transported in major amounts thus achieving substantial rationalization and a noteable reduction in material requirements envolved with product packaging.

The configuration of the bulk container as suggested by the invention to which reference will be made in closer detail in the following, permits an easy manufacture and preparation and a safe product transport, with a sterile sealing of the foil bag required for maintaining the product quality being at any time safeguarded by the outlet means, it being readily possible to package product quantities in amounts of more than 1000 liters. During transportation and storage of the, sterile sealing of the outlet means is solely effected by the draining tongue. For this purpose, a closure plate of plastic material is welded thereinto, which will be opened for dispensing purposes. The easiest alternative to manufacture a closure plate of this type is provided by welding the draining tongue made of plastic material and being of a substantially circular configuration directly on the foil bag made of foil. However, according to a preferred embodiment of the draining tongue as suggested by the invention, the draining tongue is to be closed by a separate closure plate envolving the substantial advantage that the connection between the draining tongue and the foil of the foil bag can be configured in a substantially more favorable manner thereby enabling, as described in the following, an advantageous operation of said outlet mechanism. Another advantage envolved with the draining tongue to be preferred according to the invention resides in that the thickness of the closure plate can be selected irrespective of the thickness of the foil bag. The additional advantages arising therefrom will also be described in the following. As the foil bag, in the practice of the invention, in collapsed condition, can be placed into the envelope, it may envolve difficulties to introduce the draining tongue into the corresponding opening of the envelope. In the practice of the invention, the draining tongue is, therefore, provided with a transverse stem to be preferably located in the upper third of the tongue. This will enable the draining tongue to be seized by the transverse stem and to be introduced into the port of the envelope. The draining tongue, moreover, at the outer circumference thereof, may be provided with a circumferential groove of a configuration such that after passage of the tongue through the envelope, the same can be easily held by means of a holding mechanism of horse-shoe-type configuration. During transportation, a protective cap can be mounted onto the draining tongue which, at the same time, can serve as a customs bond cap. An absorbent material, e.g. a gauze tampon, may be provided in the cavity between the closure plate and the protective cap, especially in transports into tropical countries, which tampon is soaked with an insect controlling agent or an insecticide. Experience has shown that insects are not capable to penetrate the cardboard of which the envelope is made. Nevertheless they might succeed in piercing the relatively soft plastic material of the closure plate. This will be precluded by the correspondingly soaked absorbent material between the protective cap and the closure plate.

Draining tongue and discharge mechanism are required to permanently seal the product aseptically from the atmosphere. The closure plate in the draining tongue must, therefore, be capable of being opened and the discharge mechanism must be capable of being mounted onto the draining tongue without affecting the said sterile seal. It is, therefore, suggested by the invention to incorporate into the discharge mechanism a push bar including a knife blade piercing the closure plate after mounting of the discharge mechanism. This will envolve the problem that the discharge mechanism, admittedly, can be suitably sterilized beforehand in a sterilizing bath or the like, but that the said sterility can again get lost during mounting of the discharge mechanism on the draining tongue. The invention, therefore, additionally provides to so proceed that after mounting of the discharge mechanism, all parts contacting the product are rinsed either with hot vapor if the product is adequately resistant to heat, or with a cold disinfecting solution thereby disinfecting all parts getting into contact with the product before the actual employment of the blade for opening the closure plate. The opening blade or the push rod connected therewith, respectively, hence, will be actuated only after the discharge mechanism having been mounted onto the draining tongue and both parts having been correspondingly disinfected.

The apparatus of the invention in conjunction with the process equally essential of the invention, hence, enables the discharge mechanism to be mounted onto the draining tongue and safeguards, prior to opening the closure plate, a complete sterility of all parts of the discharge mechanism getting into contact with the product.

In accordance with the problem basic to the invention, the sterility of the draining apparatus must be safeguarded throughout the time of discharge of the product. This will present the problem that the translatory movement of the push rod must be capable of being suitably sealed in sterile manner against the atmosphere. Moreover, a sterile sealing must be effected at the point of connection between the discharge mechanism and the draining tongue as well as on the remaining partial joints of the housing of the discharge mechanism. Standard state-of-the-art seals, such as 0-ring seals for sealing parts not moving relatively with respect to one another, and packing boxes for parts movable relatively with respect to one another, cannot be readily employed, as such sealings do not offer an adequate protection to prevent bacteria from growing through the sealing gap. The invention, therefore, suggests to scavenge the said seals in a permanent circuit, by a disinfecting liquid thereby reliably precluding penetration of the bacteria through such seals. However, a sterile rinsing of this type will not be applicable to the parts of the discharge mechanism getting into contact with the product stored in the said container, as the disinfecting fluids might affect the product quality, or, in the event of foodstuffs, render same unfit for human consumption. The seal between the push rod moving in translatory relationship within the discharge mechanism, and the discharge mechanism itself, in the practice of the invention, is, therefore, performed through a diaphragm which, on the end, is rigidly connected to the push rod and, on the other end, is rigidly connected to the discharge mechanism and which causes a complete and sterile seal between the interior of the discharge mechanism and the environment.

The said diaphragm seal, in accordance with the given conditions, can be of different configuration. What is of decisive importance is that the diaphragm permits an adequate movement of the push rod to achieve a reliable opening of the closure plate of the container. This can be performed, for example, by a diaphragm with wrinkling bellows, which, depending on product and sterilization process can be made either of stainless steel or of a plastic material. According to an alternative form of embodiment of the invention, the diaphragm is a plate-type membrane the cross-sectional configuration of which, if need be, can be such that the deformation of the membrane is facilitated thereby permitting an improved movement of the push rod.

Another configuration problem envolved with the discharge mechanism is the arrangement of the push rod. In this respect, it is suggested by the invention, to dispose the push rod at two points, viz., on the one hand, in a bearing disposed externally of the discharge mechanism and within the draining tongue by correspondingly configuring the opening blade thereby attaining a reliable arrangement of the push rod which, in addition, envolves the advantage that no other problems arise with respect to the sterility of the discharge mechanism. This also exhibits the substantial advantage of separating the sterile chamber within the discharge mechanism from the atmosphere by means of the completely sealing membrane.

The opening blade, in the practice of the invention, is of a fish-mouth-type configuration meaning that an opening is cut from the closure plate substantially embracing the bottom semi-circular section of the circular surface of the closure plate. This configuration exhibits a variety of advantages: on the one hand, the substantially semi-circular configuration enables the discharge opening of the foil bag to be displaced to a particularly high degree to the bottom. In addition, the upper part of the closure plate, in this configuration, can continue to be connected to the foil bag so that the closure plate with the partly cut open bottom part, forms some sort of check valve precluding that the membrane pump used for emptying the foil bag, will absorb the gas contained in the foil bag, the function of which will be explained in greater detail in the following. Tests have proved that with this configuration of the discharge opening, a substantially complete emptying of the foil bag is achieved, with a discharge of the product of up to 99,75 being safeguarded in cooperation with additional configurational suggestions of the invention to be explained in greater detail in the following.

The configuration of the foil bag is of substantial importance to the function of the present invention. The foil bag is required to be so configured as to optimally conform to the generally rectangular format of the enclosing container. Moreover, the configuration must enable the foil bag introduced in collapsed condition into the envelope, to unfold automatically, if possible, during loading so that the unfolding process does not require manual assistance by an operator.

The easiest way of producing a foil bag of this type is provided by superposing two rectangular foil webs and sealing the same together at the edges thereof. The said foil bag if filled, for example, with air, is in the form of a cushion. As the foil bag is not able to withstand the load of the product itself, the size of the envelope will have to be so selected as so cause the foil bag to abut the internal side of the envelope as uniformly as possible. The internal volume of the foil bag is, therefore, required to be substantially in excess of that of the envelope. However, as the container to be used, normally, is rectangular in shape, this will have the consequence, that the foil bag, on the one hand, will have to be sized such that the volume is noteably in excess of the volume of the envelope and, on the other hand, such that the volume "excesses" of the foil bag are non-uniformly distributed, i.e. the foil bag especially in the corners of the cardboard box will fold up or scrunch together thereby causing irregular loads on the welding joints and the formation of "hollow pockets" resulting in excessive stretching and, hence, in a reduced operating safety of the container as the foil at that point is exposed to the full pressure of the product.

The invention, therefore, suggests a completely different configuration of the foil bag wherein, equally, two foil webs are superposed which, however, are given a special folding during superposing. The shape of the foil bag of the invention, in the following will be described by the process of the manufacture thereof, with the edges of the superposed foil webs, for the sake of an easier understanding, being designated as longitudinal and transverse edges, although the edges may be of identical length. In the practice of the invention, the folding is attained in that first the bottom foil web is spread. Thereafter, the foil, in the longitudinal direction, at both sides is folded symmetrically inwardly so that an area is left at the bottommost layer corresponding approximately to one fourth of the preceding width of the transverse edge. The parts of the foil web first folded inwardly are then bent outwardly in a manner such that the part of the foil web now lying uppermost and being turned outwardly noteably protrudes beyond the bottommost part of the foil web. The foil web then comprises two symmetrically inwardly directed fold-ups and, in superposed relationship, two outwardly directed fold-ups equally of symmetrical configuration. A correspondingly folded upper web is so placed onto the said web that the outwardly turned parts of the folded webs are in mating relationship. Then the webs are circumferentially welded, with the folds at the transverse edges being also welded thereinto, at this point, resulting in an area in which the foils are superposed in six-fold strength.

The resultant shape of the bag can be optimally adapted to rectangular envelopes. The tags remaining in the corners are substantially smaller than with the afore-described configuration so that the product amount left in the container and incapable of being discharged is substantially reduced. Another advantages involved with the configuration of the foil bag as suggested by the invention resides in that the welding seam after charging of the container, is in the center of the container, i.e. at a point where the pressure exerted by the product on the envelope is only half of that exerted on the container bottom side. Moreover, the welding seam in this area can optimally abut the container walls so that the pressure of the product exerted on the welding seam can be directly passed on to the envelope without affecting the stability of the welding seam. Another advantage involved with this shape of the foil bag is the easy unfolding thereof. The foil bag automatically erects during loading without forming intertwinements or the like thus not requiring any additional efforts to place the bag into its proper shape. Another advantage resides in that the manufacture of the said foil bag is particularly favorable to manage. As the foil bag owing to the repeated folding thereof is relatively thin as compared with the volume thereof, the manufacture despite the expanded foil web as used can be performed on a narrow-sized welding table thereby substantially reducing the manufacturing costs. Further cost savings are achieved in that as a result of the bag's proper conforming to the rectangular shape of the container, substantially less foil is consumed for the same container capacity.

To favour a substantially complete evacuation of the foil bag, it is suggested by the invention, to introduce into the envelope key-shaped elements causing a chute-type inclination of the bottom part of the foil bag, with such elements being so configured as to cause the bottom edge of the said chute to precisely extend to the draining tongue. Such forming elements, in the practice of the invention, in simple manner, can be punched from cardboard and can be folded together, with the matrix consisting of an elongated rectangle laterally connected integrally to respectively two right-angled triangles extending at an acute angle to the shorter center line of the rectangle, with the elongated rectangle prolongating by the same amount beyond the hypotenuse of the triangles as corresponds to the length of the leg of the side of the triangle facing away from the central line. By bending the four right triangles and the two protruding parts of the elongated rectangle by about 90° downwardly, a shaping element inclined in both directions arises which is in superposed relationship with the leg of extended length. The shaping element is respectively inwardly inclined by the acute angle of the triangles, hence, supporting the product draining. In accordance with the size ratios of the container, a variety of such shaping elements can be inserted in side-by-side relationship.

The envelope, feasibly, is made of cardboard, with special attention being paid to the configuration as the container size and the resultant weight of the filled-up container will place high requirements upon the strength of the envelope. It is, therefore, suggested by the invention to build up the envelope of three corrugated cardboard boxes. The outer part of the envelope is a cardboard box made of corrugated cardboard having a perpendicular direction of corrugation, which cardboard box, in usual manner, has been provided with bottom and top bending covers. Inserted into the said cardboard box are two L-shaped rectangularly edged cardboard pieces in abutment with the four side walls of the outer cardboard, it being essential that these two reinforcing elements have a transverse corrugation, so as to be able to optimally absorb the pressure exerted by the product on the side walls. Subsequently, an inner cardboard box is then introduced into the said reinforcing cardboard boxes, which has narrow-sized bending edges at the top and bottom and which is equally provided with a perpendicular corrugation. The outer and inner cardboard boxes, hence, are more able to absorb the loads acting in the perpendicular direction, while the reinforcing layer absorbs the pressure exerted on the side walls to preclude a bulging of the envelope.

Joining together the individual parts of the foil bag container as suggested by the invention in case of major dimensions might present certain problems. To anticipate such problems, the invention suggests a method of preparation, employing a special apparatus substantially simplifying the fixing together of the individual components of the envelope. The apparatus is made, for example, of steel rods or wood and, in its outer dimensions, corresponds to the inner dimensions of the envelope standing overhead, with the height being somewhat more extended to provide appropriate space for the bending flaps of the cardboard box. The top of the said apparatus is of roof-shaped configuration to conform to the course of inclination of the shaping elements. Moreover, the apparatus comprises a milling device the task of which will be described later.

According to the process of fixing together the envelope as suggested by the invention, first the inner cardboard box is put over the apparatus. Thereafter, the shaping elements are mounted and the outer cardboard box is turned over. Subsequently, the L-shaped reinforcing parts are inserted into the space between the inner and outer boxes, and the bottom flaps of the inner and outer cardboard boxes are bent. After that, a hole is cut into the boxes by means of the afore-mentioned milling device, the diameter of which corresponds to the outer diameter of the draining tongue. The fact that the hole will be cut only after the cardboard boxes having been fixed together, involves the substantial advantage that the tolerances of the port and of the draining tongue can be so configured as to cause the draining tongue to be seated relatively firmly in the said port. This would not be possible if the ports for the draining tongue were punched thereinto already during cutting of the individual parts of the cardboard, as in that case relatively high tolerances would be required to be provided to safeguard that the individual ports are sommating that the draining tongue is allowed to pass therethrough. In that case, the draining tongue is not held by the cardboard box resulting in an increased strain of the foil in the vicinity of the draining tongue. This strain, in the envelope of the foil bag as prepared according to the invention, is completely absorbed by the envelope.

The discharge of the product from the bulk container can, as already previously mentioned, be effected, for example, by means of a diaphragm pump. However, the potential problem resides in that the foil bag increasingly collapsing in the course of the discharge precludes the desired substantially complete discharge of the product. It is, therefore, suggested by the invention to keep the foil bag, during discharge, permanently at a slight overpressure to prevent a collapse of the foil bag from occurring. In accordance with the problem to be solved by the invention, it will be necessary to see to it that the introduction of the overpressure into the foil bag does not affect the sterility of the product. Sterile gases such as sterilized air, nitrogen or carbon dioxide, will, therefor have to be introduced into the foil bag. To keep the efforts for the pressure generation low, it is advantageous to use a pressure bottle which, via a choke valve and an overpressure safety valve is connected to the foil bag by a sterile line. The overpressure within the foil bag must be so dimensioned that, on the one hand, the collapse of the bag is reliably precluded, but that, on the other hand, the strain of the foil bag is not increased by the gas as introduced. An overpressure of, for example, about 0.05 bar has proved to be advantageous.

Various other objects, features and attendant advantages of the present invention will be more fully understood from the following description with reference to the enclosed drawings, wherein.

Figure 1:
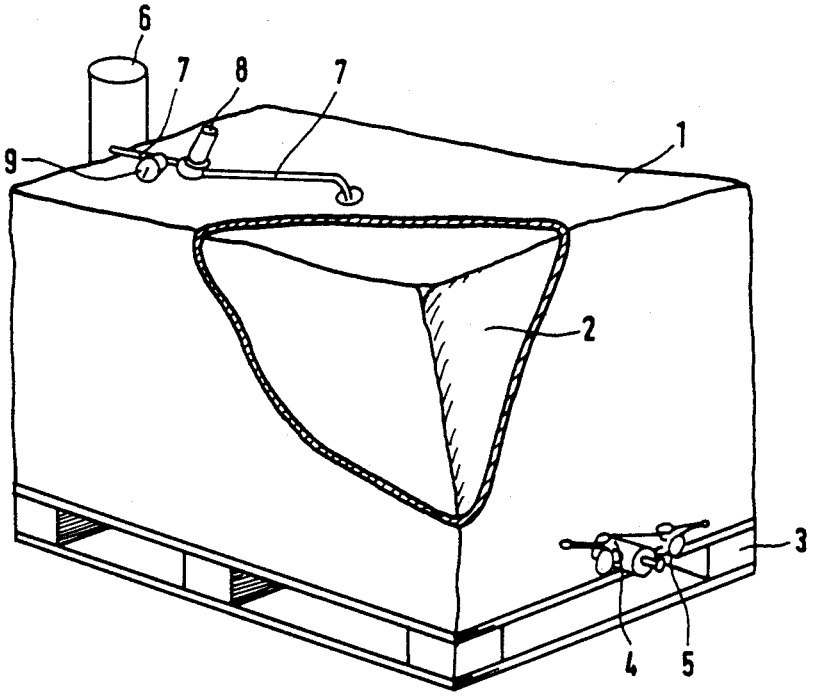
FIG. 1 is a partial sectional view of the bulk container provided by the invention.
Figure 3:
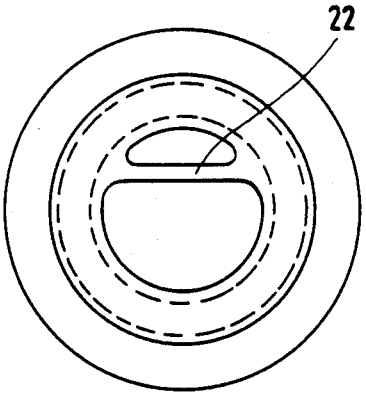
FIG. 3 is a plan view of the draining tongue according to FIG. 2.

With reference to the drawings, FIG. 1 is a partly sectional view of a preferred form of embodiment of the bulk container according to the invention. The bulk container comprises an envelope 1 enclosing a foil bag 2. For simplifying the transport, the envelope along with the foil bag contained therein is disposed on a pallet 3. Welded to the foil bag 2 is a draining tongue 4 which is in communication with a discharge mechanism 5. The discharge mechanism 5 is in communication with a diaphragm pump (not shown) drawing off the product from the container. Provided on the side wall of the envelope is a gas bottle 6 which, via a line 7, is in communication with the foil bag 2 by means of a pressure control device 8 (not shown) and a manometer 9. The gas bottle contains high-pressurized nitrogen, carbon dioxide or sterile air, with the selection of the respectively employed gas being dependent, above all, on the product contained in the container. The pressure of the gas bottle, via the pressure controlling devices is reduced to a pressure of 0.05 bar, with the overpressure and, hence, the function of the entire means for pressurizing the foil bag being capable of being controlled by the manometer 9. The gas bottle, throughout the discharge time, remains in communication with the foil bag. This not only involves the afore-described advantage that the foil bag cannot collapse during the discharge, but rather also the additional advantage that leakage in the foil bag is noted without delay, as in that case the pressure on the manometer correspondingly drops. It is precluded thereby that an unnoticed leakage of the foil bag is liable to result in spoiling the product, which is particularly important for cases where the container comprises a high internal volume as otherwise an unnoticed leakage could spoil large product quantities.

The manometer, hence, is an important indicator to the consumer of the product, signaling a proper function of the entire system.

Figure 2:
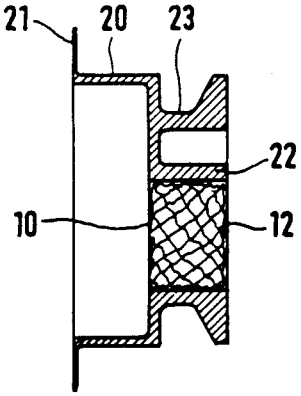
FIG. 2 is a cross-sectional view of the draining tongue according to the invention.
Figure 5:
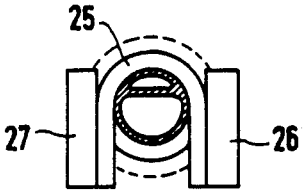
FIG. 5 is a plan view of the attachment of the draining tongue.
Figure 4:
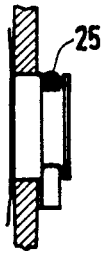
FIG. 4 shows the attachment of the draining tongue according to FIG. 2, to the envelope.
Figure 6:
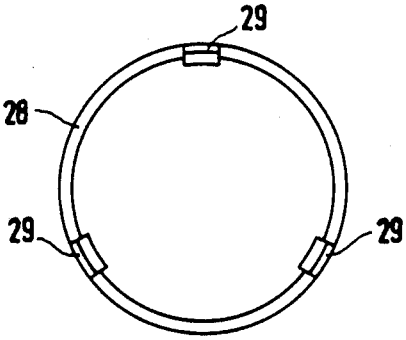
FIG. 6 is a bottom view of a cap for closing a draining tongue according to FIG. 2.

FIGS. 2 to 6 show a form of embodiment of a draining tongue as provided by the invention. The draining tongue is made of plastic material and is integrally formed. It comprises a tubular body 20 coupled to which is the flange 21 for welding the draining tongue to the foil bag 2. Provided on the side of the draining tongue facing the discharge mechanism is the transverse stem 22 serving to hold the draining tongue and guiding it through the port in the envelope. A closure plate 10 is welded to the stepped surface 24 of the draining tongue. It can, of course, also be formed integrally with the draining tongue. Provided ahead of the closure plate 10 is the cavity 12 into which can be introduced an absorbent material soaked with a corresponding fluid to preclude a damage to the closure plate 10 caused by insects. Groove 23 serving to hold the draining tongue and to establish communication with the discharge mechanism, extends circumferentially of the draining tongue. Insertion of the horse-shoe-type holding bracket 25 is shown in FIGS. 4 and 5. Holding ribs 26 and 27 are provided on the envelope, precluding, on the one hand, that the holding bracket 25 separates from the draining tongue and improving, on the other hand, attachment of the draining tongue to the envelope. FIG. 6 is a bottom view of a protective cap 28 mounted to the draining tongue and precluding a damage to the draining tongue and the closure plate during transport. The protective cap 28 includes three holding stems 29 engaging the groove 23 of the draining tongue. The protective cap 28 is made of plastic material as is the draining tongue. The closure plate 10 can either directly be the foil bag, as shown in FIG. 2, or a thicker closure plate of plastic material can be welded into the tubular body 20.

The draining tongue 4 is of a configuration such that a sterilization of the tongue with vapor of a temperature of between 120° and 140° C. does not cause damage to the plastic material. This is especially attained by the comparatively amply dimensioned cross-section of the draining tongue.

Figure 7:
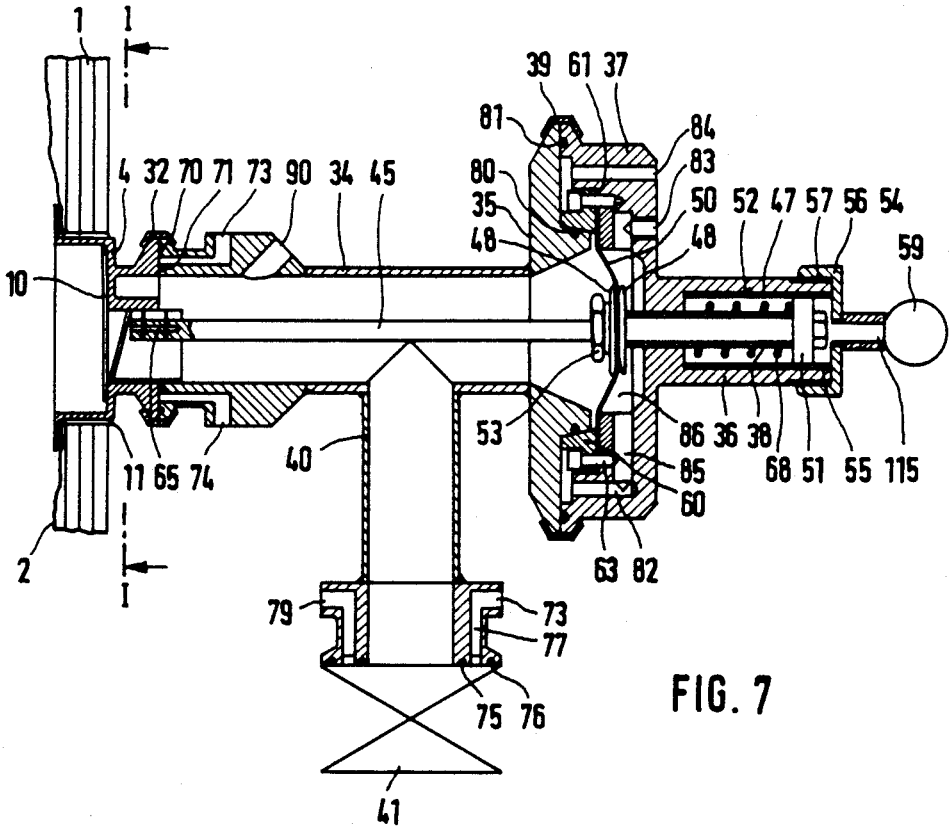
FIG. 7 shows a discharge mechanism to be connected to a draining tongue according to FIG. 2, wherein the seal is a plate-type diaphragm.

FIG. 7 shows, in simplified form, a cross-sectional view of one form of embodiment of the discharge mechanism as provided by the invention. The left-hand part of the illustration discloses the envelope 1 into which is inserted the foil bag 2. The foil bag 2 is welded to the draining tongue 4 which is guided through the bore 11 of the envelope. Welded into the draining tongue 4 is the closure plate 10 which, during transport and during preparation for the discharge, will safeguard the sterile sealing of the said product contained in the foil bag. Mounted to the draining tongue is the discharge mechanism 5. Fixation of the discharge mechanism to the draining tongue is effected by means of a rivet tape 32 of a U-shaped profile and engaging a corresponding holding groove of the discharge mechanism. Fixation of the tape is effected by screwing not shown in any closer detail. The discharge mechanism essentially comprises a tubular housing 34 expanded by the head flange 35. Housing 34 and head flange 35 are made of stainless steel and are welded together. Mounted to flange 35 is header 36 which comprises a flange-type mounting element 37 and a tubular connecting element 38 which are integrally formed. The head flange 35 and the flange-type mounting element 37, in turn, are interconnected by means of a second rivet tape 39. The tubular housing 34, moreover, comprises the discharge nozzle 40 which, via the schematically illustrated aseptical discharge valve 41, is in communication with a diaphragm pump (not shown). A push rod 45 is so disposed within the discharge mechanism that it is longitudinally displaceable. The push rod comprises a rod 46 on which is mounted a sleeve 47 in the area of the header 36. At the side of the sleeve facing the foil bag, two discs 48 and 49 are mounted on the rod 46, between which is held the diaphragm 50. Disposed next to the other end of the sleeve is a ring 51 safeguarding the guidance of the push rod in the bearing bore 52. The sleeve 47, the discs 48,49 with the diaphragm 50 disposed therebetween and the ring 51 are held by counter-acting nuts 53 and 54 engaging a corresponding thread of rod 46. The bearing bore 52 contains a insert 55 to minimize friction and wear. Bearing bore 52 is closed by means of a lid 56 engaging a corresponding thread 57 on the tubular connecting element 38. The push rod 45, through a bore 58 in the lid 56, is guided outwardly and is provided with a ball 59 facilitating the manual actuation of the push rod. A spacer 64 may be provided between the ball 59 and the lid 56 preventing the push rod from being moved, during the discharging operation, toward the foil bag by the vacuum of the diaphragm pump.

The diaphragm 50, in the present instance, is made of plastic material; however, it will also be possible to make the diaphragm, depending on the requirements placed thereupon, of a suitable metallic material. The outer circumference of the diaphragm 50 is held between the clamping ring 60 and a corresponding face of abutment 61 of the flange-type mounting member 37. The clamping force is applied by a total of twelve clamping screws 62 distributed along the circumference of the clamping ring 60 and the flange-type mounting element 37 and engaging corresponding thread bores 63 in the flange-shaped mounting element 37.

Figure 8:
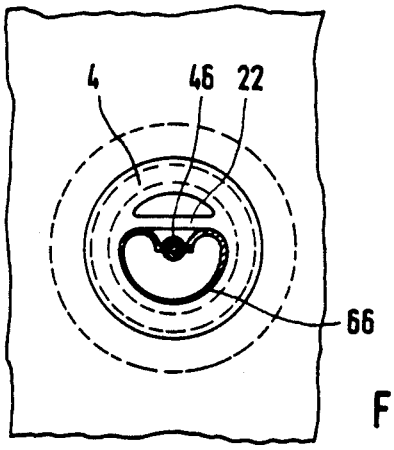
FIG. 8 is a sectional view along the line I—I in FIG. 7.

On the side of the push rod facing the foil bag, the opening blade 66 is secured in a slot 65 of rod 46. The opening blade 66 is—as shown by FIG. 8—of a fish mouth-type configuration serving to cut open the closure plate 10. To support the cutting operation, the front edge 67 of the opening blade 66, over the vertical, is slightly inclined back. The opening blade 66 is so configured as to cause the front portion of the push rod to be guided in the bore of the draining tongue 4. The height of the opening blade, hence, corresponds approximately to the space between the transverse stem 22 and the lower edge of the bore of the draining tongue. The opening blade 66 is of a tubular shape so that the product to be discharged from the container can readily flow through the opening blade. The opening blade causes a complete separation of the closure plate 10 thereby achieving that the piece of the closure plate 10 cut out by the opening blade, also after opening, viz. at the level of the stem 22 of the draining tongue 4, will remain in communication with the remaining part o the closure plate 10, thereby forming some sort of a check valve preventing the diaphragm pump from drawing off gas if the product level in the foil bag has decreased to below the level of the stem 22 of the draining tongue. This will enhance the complete discharge of the product.

The guidance length of the push rod determined by the opening blade, and the corresponding depth of the draining tongue will have to be adapted to the length of the bearing bore 52 such that the opening blade 66 be not retracted from the draining tongue to such an extent that the guidance between the opening blade and the draining tongue will get lost. As the push rod 45, by spring 68 is fixed in the position farthest away from the closure plate, the height of ring 51, the height of screw 54 and the length of spring 68 in relation to the length of the bearing bore 52 will have to be so dimensioned that the axial movement required for piercing the closure plate 10 and/or the foil bag 2 is permitted.

As previously set out, the seals of the discharge mechanism will have to be so designed as to prevent bacteria from growing through the seal even several weeks after commencement of the discharge. For this purpose, the seals of the discharge mechanism are scavenged by an aseptical fluid. The sealing joints, therefore, comprise an annular circumferential channel which is provided with an in-flow and an out-flow. The individual in-flows and off-flows are connected to a circulating pump safeguarding a permanent circulation of the aseptical fluid in the discharge mechanism. The corresponding circulating means, storage container etc. are known per se and will presently not be described in any detail. The sealing between the outlet tongue and the discharge mechanism is effected by a first O-ring seal 70 and a second O-ring seal 71, with the diameter of the first O-ring seal being smaller than the one of the second O-ring seal. The first annular channel 72 with in-flow 73 and out-flow 74 extends between the two O-ring seals. The annular channel is of a configuration such that the joint between the first O-ring seal 70 and the second O-ring seal 71 is scavenged by the aseptical fluid, with the first O-ring seal 70 precluding that the aseptical rinsing fluid is admitted to the interior of the tubular housing 34 of the discharge mechanism and contacts the product. The second O-ring seal 71 prevents the aseptical fluid from being discharged to the outside. The contact force between the discharge mechanism and the draining tongue required for causing the sealing effect is generated by the legs of the U-shaped tape 32 supported on the corresponding bevels of groove 23 of the draining tongue 4 and the groove 33 of the tubular housing 34. The sealing between the discharge nozzle and the sterile discharge valve, in similar manner, is effected by a third O-ring seal 75 and a fourth O-ring seal 76. Disposed therebetween is the second annular channel 77 scavenged, via in-flow 78, with aseptical fluid which is discharged again through the out-flow 79. The function of the seal corresponds to the function of the one described in the afore-going for which reason it need not be explained in any greater detail.

Sealing between the interior of the discharge mechanism and the environment is effected at the head flange 35 of the discharge mechanism with the aid of the plate diaphragm 50. As in the afore-described sealing, another O-ring seal is provided, namely the fifth O-ring seal 80 between the head flange 35 and the clamping ring 60, and the sixth O-ring seal 81 between the outer circumference of the head flange 35 and the flange-type mounting element 37. Formed between the O-ring seals is a third annular channel 82 connected to the in-flow 83 and the out-flow 84 and scavenged by an aseptical fluid. This rinsing will prevent bacteria from growing through the sealing joint between the head flange 35 and the flange-type mounting member 37. However, penetration of the bacteria will also have to be precluded between the points of attachment of the diaphragm. For this purpose, the feed-port 85 is provided through which aseptical fluid enters the cavity 86 at the side of the diaphragm turning away from the foil bag from where the aseptical fluid, via a corresponding port, is fed to out-flow 84 of the previously mentioned third annular channel.

By having all seals of the discharge mechanism washed around with an aseptical liquid, sterility of the discharge mechanism will be reliably safeguarded over a period of time of any desired length. However, the safe operation of the discharge mechanism will require a reliable disinfection or sterilization of the internal parts of the discharge mechanism getting into contact with the product prior to actuating the push rod for opening the closure plate. For this purpose, it is provided by the invention that the discharge mechanism 5 is disinfected prior to being mounted onto the draining tongue 4. Such a disinfection, normally, is performed by a sterilizing bath; however, a sterilization can also be effected by hot vapor. Such a pre-sterilization will, however, not be adequate, as the discharge mechanism, during assembly, is liable to become infected again. In addition, the interior of the draining tongue and the side of the closure plate 10 facing the environment, after the transport, will no longer be sterile. For that reason, it will be advantageous for the discharge mechanism to be first pre-sterilized, then mounted upon the draining tongue and secured by the rivet tape 32. Subsequently, hot vapor or a disinfecting fluid is fed into the discharge mechanism through the sterilizing port 90 via a corresponding line (not shown). The sterilizing fluid will get into contact with all parts of the discharge mechanism, of the draining tongue and of the closure plate which, in turn, get into contact with the product and are no longer sterile after the transport and the discharge from the sterilizing bath, respectively. After sterilization, the sterilizing medium is discarded through a corresponding run-off (not shown); thereafter, all parts getting into contact with the product have been made sterile. The sterilizing fluid can either be hot vapor or a cold disinfecting liquid, with the selection being dependent on the type and nature of the product contained in the foil bag. In a hot vapor sterilization, preferably, super-heated vapor of a temperature of between 120° and 140° C. is used, which permits a complete sterilization within a relatively short period of time. The plastic parts of the draining tongue are, as previously mentioned, of a consistency such that they readily withstand the high temperature. The rest of the parts of the discharge mechanism are preferably made of stainless steel so that the sterilizing temperature has no detrimental effect thereon. When using a plastic plate diaphragm 50, the corresponding temperature resistance will have to be observed; when employing a stainless steel diaphragm, the sterilizing temperature does not involve any problems.

The cold disinfecting solution is especially employed in cases where the product contained in the foil bag is sensitive to heat. If the foil bag contains a foodstuff provision will have to be made that the disinfecting fluid does not leave any residuals detrimental to human consumption and that the taste of the product is not affected by the residuals of the disinfecting fluid. However, this will apply only to the disinfecting fluid introduced into the interior of the discharge mechanism prior to opening the foil bag. The seal used between the annular channels wherein the aseptical rinsing fluid required for maintaining the sealing sterile, circulates, and the interior of the discharge mechanism is of such a high quality that a detrimental effect on the product contained in the foil bag by the aseptical rinsing fluid, can be precluded.

Figure 9:
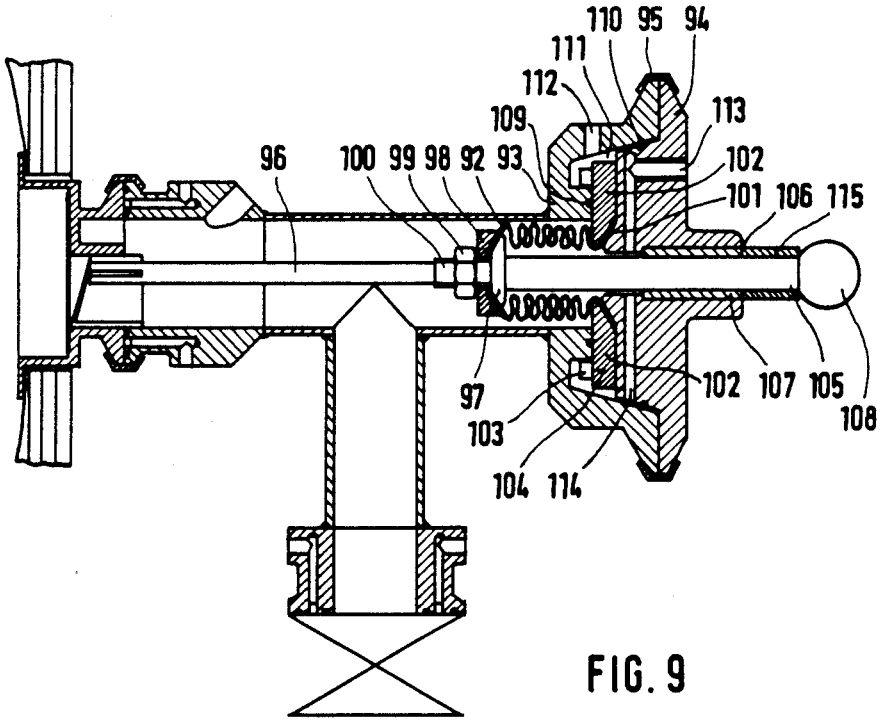
FIG. 9 shows a discharge mechanism to be connected to the draining tongue according to FIG. 2, wherein the seal is a membrane with wrinkling bellows.

FIG. 9 shows an alternative form of embodiment of the invention wherein the diaphragm is a membrane 92 with wrinkling bellows. To the extent as the embodiment corresponds to that of FIG. 7, the same reference numerals have been used; a repetition of the description in respect of these parts can be foregone.

A different construction arises with head flange 93 cooperating with mounting element 94. The two parts are again held together by a U-shaped tape 95. The front portion of push rod 96 is of the same configuration as the embodiment of FIG. 7. An annular lug 97 is provided for holding the wrinkling bellows, which is rigidly connected to the push rod and is forced against the clamping ring 98. The clamping force is applied by nut 99 engaging thread 100 of the push rod. The other end of membrane 92 with wrinkling bellows is held in similar manner. The flange-type mounting element 94 comprises a face of abutment 101 on which is supported the end of the membrane with wrinkling bellows. Another clamping ring 102 is forced onto the supporting face by means of 12 screws 103 engaging thread openings 104 of the mounting element 94. Push rod 96, at the rear end thereof, includes a concentration 105 which is disposed in longitudinally movable manner into a corresponding bearing bore 106 of the mounting element. Provided in the bearing bore 106 is a sealing sleeve 107. For purposes of actuation, again, a button 108 is provided. Button 108, at the same time, acts as a stop and limits the pushing effect of the push rod toward the foil bag so as to prevent excessive load on the membrane 94 from occurring. The full range deflection in the opposite direction, i.e. upon removal of the push rod 96, is given by the annular lug 97. Here, too, the length should again be so harmonized as to maintain guidance of the front part of the push rod 96 in the draining tongue 4. No spring for automatically resetting the push rod is provided in this instance; the push rod, after opening of the closure plate 10, is reset by the operator to the initial position.

To safeguard a bacteria-tight sealing in this discharge mechanism over an extended period of time, the sealing joints of the apparatus will again have to be rinsed with an aseptical fluid. Disposed in the sealing joint between the mounting element 94 and the head flange 93 is a first inner O-ring seal 109 and a second outer O-ring seal 110 enclosing a substantially annularly shaped channel 111 through which the aseptical fluid flows. The said fluid enters the annular channel through an inflow 112 and is drained by a corresponding outflow not shown in the simplified illustration. The interior of the membrane with wrinkling bellows is equally rinsed by an aseptical fluid. For this purpose, a second inflow 113 is provided which terminates in a gap chamber 114. The aseptical fluid flows from the gap chamber into the space extending between the concentration 105 and the membrane 92. The sealing of this interval against the environment is effected by the previously mentioned sealing sleeve 107. The membrane with wrinkling bellows over the plate-type diaphragm exhibits the advantage that it permits an essentially larger stroke of the push rod.

Figure 10:
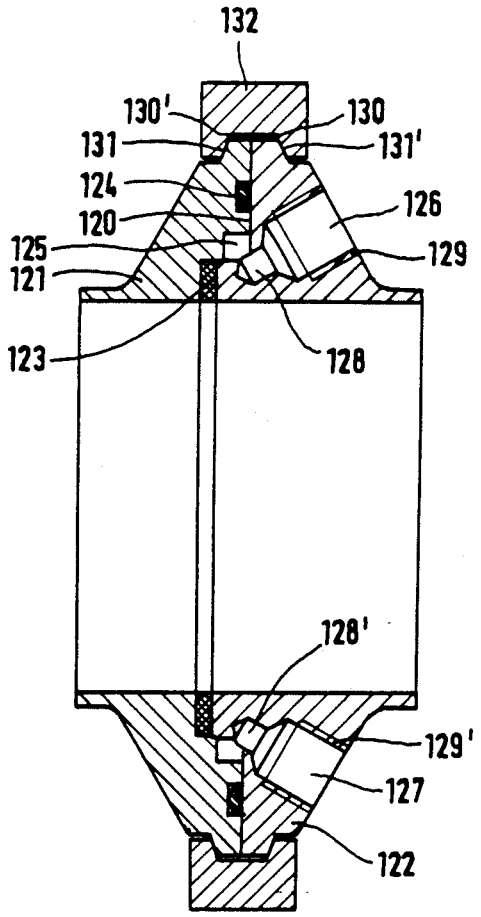
FIG. 10 shows an embodiment of a seal between parts relatively stationary with respect to one another as suggested by the invention.

FIG. 10 shows another configuration alternative of a sterile seal as can be used, for example, between draining tongue and discharge mechanism. The sealing joint 120 is provided between the first flange 121 and the second flange 122. The sealing over the interior of the flange portions is effected through the sealing ring 123 of essentially rectangular configuration, whereas the sealing over the environment is effected by the O-ring seal 124 provided in the perpendicular partial joint of the flanges. The aseptical liquid flows through the annular channel 125, it being supplied through the feed bore 126 and drained through the outflow bore 127. The bores are made of a blind hole 128 and 128', respectively, joined by a thread portion 129,129'. Bolted into that thread portion in known manner is the connecting conduit to the recirculating device for recirculating the aseptical rinsing fluid. The rivet tape 132 of similar U-shaped cross-section holds the two flanges 121 and 122 together and at the same time provides for the contact force of the sealing. For this purpose, the tape 129 is provided with slopes 130 and 130' respectively which are supported on corresponding slopes 131 and 131' respectively, of the flanges. These slopings safeguard that a normal force acting in the axial direction of the flanges is generated providing for the required contact force of the seals.

Figure 11:
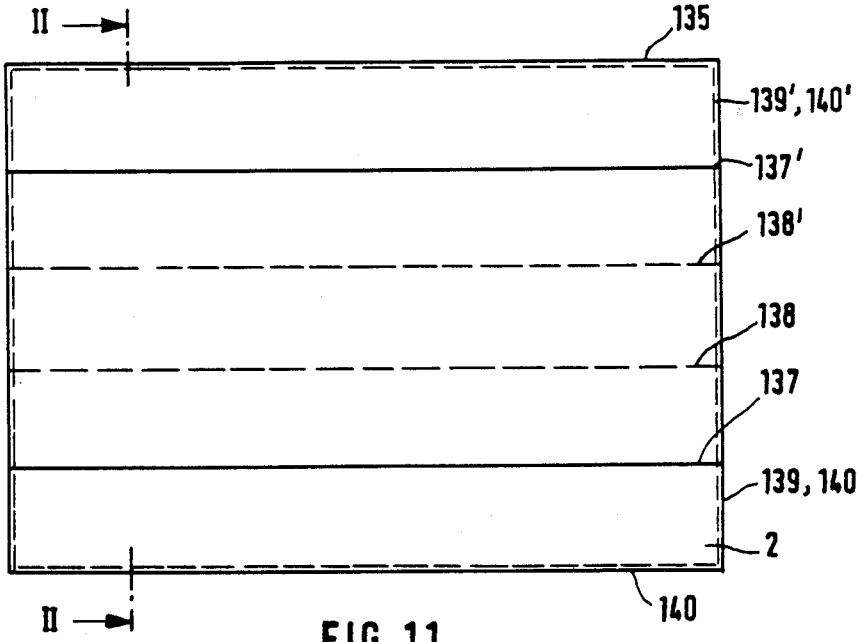
FIG. 11 is the plan view of a foil bag according to the invention.

FIG. 11 shows a form of embodiment of the foil bag according to the invention. The foil 2 is of a rectangular configuration and is welded together at the edges by the welding seam 135 shown in dash-dotted lines. The folding up of the foil bag is shown by the cross-sectional illustration of FIG. 12 revealing that two mating folded-up portions are welded together at the edges. The folding-up is of a configuration such that the foil portion 136 disposed on the bottom side, at the two sides, is first bent inwardly thereby creating the outer folding edges 137 and 137'. Thereafter, the foil is bent outwardly again thereby creating the inner folding edges 138 and 138'. The folding is so performed that an overstand-portion 139,139 arises. The folding of the upper foil portion 140 is performed in a manner symmetrical to the folding of the lower foil portion 136. The resultant overstand-portion 141 and 141' is welded together with the corresponding overstand- portion 139 of the lower foil portion 136'. The folding is so performed that the distance between the outer folding edge 137 and the inner folding edge 138 is smaller by approximately one third than the distance between the opposite inner folding edges 138 and 138'. The distance between the inner folding edge 138 and the outer edge at the welding seam of the overstand-portion 139 is irrelevantly smaller than the distance of the opposite inner bending edges 138 and 138'. The folding is fixed by the welding seam 135, with six foil webs being superposed in the area between the outer folding edge 137 and the inner folding edge 138, as also shown by FIG. 12; however, such webs can be readily welded together by welding seam 135.

Figure 12:
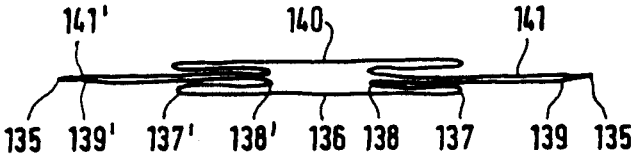
FIG. 12 is a cross-sectional view of a foil bag according to FIG. 11 along the line II—II.
Figure 13:
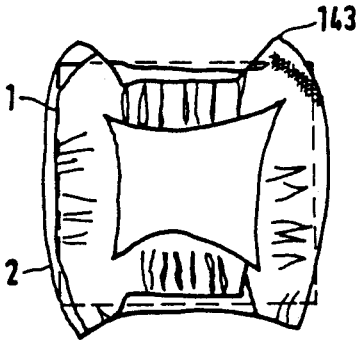
FIG. 13 shows a foil bag according to FIG. 11 in a condition filled with gas, with no envelope - as a plan view.

FIG. 13 shows in a simplified, sketchy illustration, a plan view of a gas-filled foil bag according to FIGS. 11 and 12. The possible inner cross-section of an envelope 1 suiting the said foil bag is shown in dashed lines in the sketch. It clearly reveals that the tags 143 protruding beyond the cross-section of the envelope, which after introduction of the foil bag into the envelope are unable to accommodate product, are very small meaning that the volume of the foil bag is only irrelevantly larger than the volume of the surrounding envelope 1 with the consequence that less foil is needed and that only a small product amount can be left in the tags during discharge.

Figure 14:
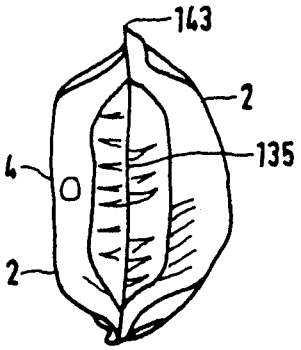
FIG. 14 is a side view of a foil bag according to FIG. 11 in a condition filled with gas.

FIG. 14 is a side view of the foil bag according to FIG. 13. This, again reveals that the said foil bag is capable to very favorably conform to a rectangular container shape. It is of special importance that the welding seam in the foil bag as shown extends precisely midway of the container thereby safeguarding an optimum abutment of the welding seam to the inner side of the envelope and precluding an excessive mechanical strain of the welding seam in loaded condition. The irrelevant over-stand in the tags in the corners of the container as shown precludes the formation of hollow pockets during loading of the foil bag with the product in which the welding seam does not optimally conform to the container interior.

FIGS. 15 to 19 show a preferred form of embodiment of the envelope in an "explosive-type" illustration.

Figure 16:
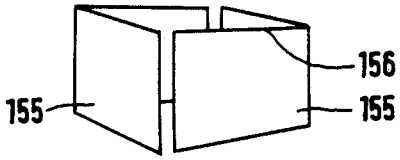
Figure 15:
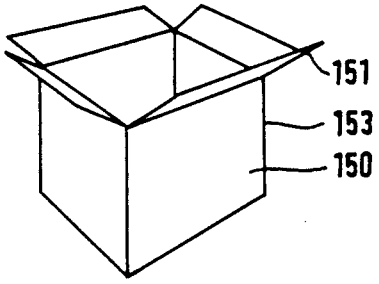

FIG. 15 shows an outer cardboard box 150 forming the outer portion of the envelope 1. The outer cardboard box 150 comprises upper bending flaps 151 and lower bending flaps 152 (not shown in FIG. 15). The outer cardboard box 150 is made of corrugated cardboard, with the direction of the corrugation being parallel to the direction of the side edges 153. FIG. 16 shows the L-shaped reinforcing portions 155 placed into the outer cardboard box according to FIG. 15 to absorb the pressure exerted by the product on the side walls. The reinforcing portions 155 are equally made of corrugated cardboard; however, in this instance, the corrugations extend in parallel to the upper edge 156 of the reinforcing portions.

Figure 17:
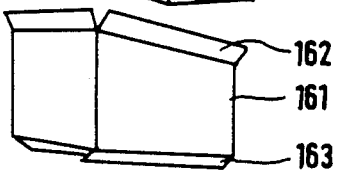

FIG. 17 shows the inner cardboard box 160 made of corrugated cardboard the corrugation of which extends in parallel to the perpendicular side edges 161. The inner cardboard box comprises short-length upper bending flaps 162 and short-length lower bending flaps 163.

Figure 18:
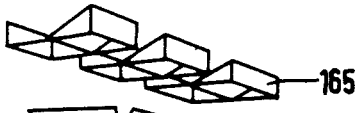

FIG. 18 shows the shaping elements 165 inserted into the envelope 1 formed of the three cardboard boxes to thereby facilitate the draining of the product and permit an improved discharge of the product.

Figure 19:
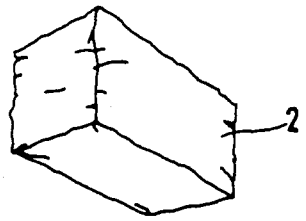
FIGS. 15 to 19 are "explosive views" of an embodiment of the envelope of the bulk container as provided by the invention.

Finally, FIG. 19 shows a foil bag 2 to be inserted into the envelope 1 in the shape it will take in the envelope.

Figure 20:
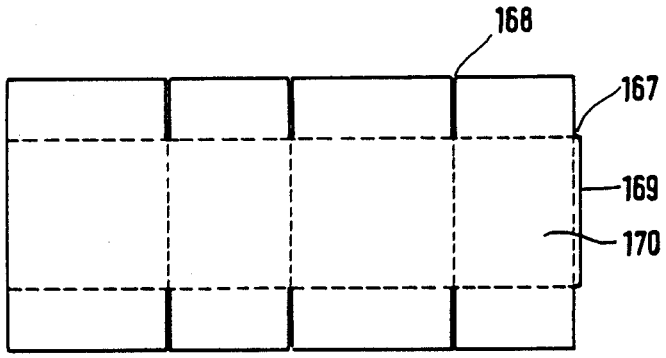
FIG. 20 shows the configuration of the outer cardboard box according to FIG. 15.

FIG. 20 shows the manufacture of the outer cardboard 150. The cardboard is cut to the desired outer dimensions and folded at the dashed edges 167 and is cut at the double edges 168. The bent 169 is suitably connected to part 170 by way of adhesive or clamps.

Figure 21:
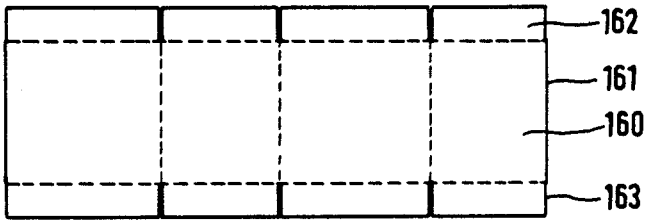
FIG. 21 shows the configuration of the inner cardboard box according to FIG. 17.

FIG. 21 shows the manufacture of the inner cardboard box 160 with the corresponding folding edges 171 and the cutting edges 172. Here, too, a bent may again be provided to lock the cardboard box in the folded-up condition.

Figure 22:
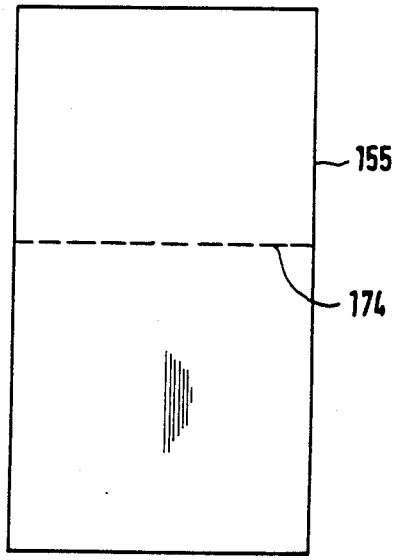
FIG. 22 shows the configuration of the reinforcing parts according to FIG. 16.

FIG. 22 shows the manufacture of L-shaped reinforcing members 155. The reinforcing members are cut out and provided with a folding edge 174 at which they are bent over at right angles in order to be placed into the outer cardboard box 150. The wave lines of the corrugated cardboard used for this purpose extend in parallel to the longitudinal axis, i.e. transverse of the folding edge 174.

Figure 23:
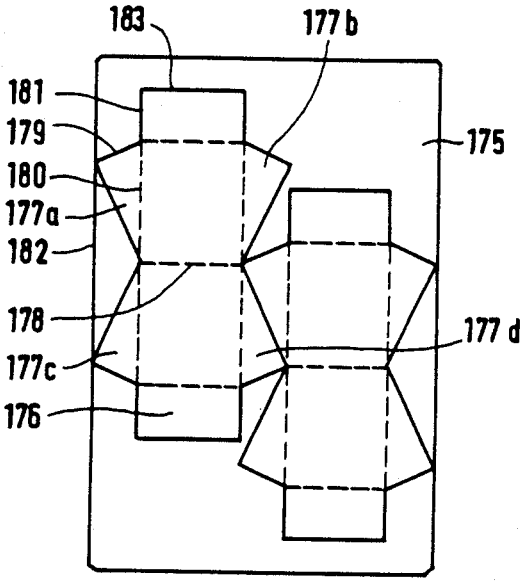
FIG. 23 shows the configuration of the shaping elements according to FIG. 18.
Figure 27:
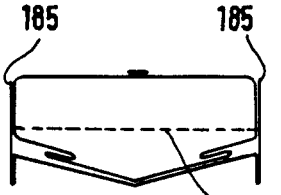
FIGS. 24 to 27 are sectional views showing unfolding of the foil bag container according to FIG. 11 in an envelope according to FIGS. 15 to 19.
Figure 26:
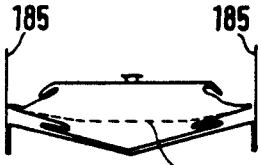
Figure 25:
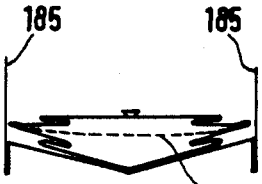
Figure 24:
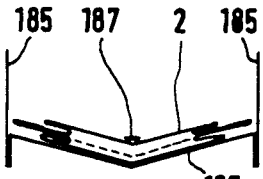
Figure 31:
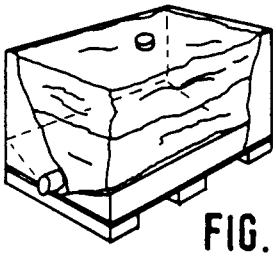
FIGS. 28 to 31 are perspective views showing unfolding of the foil bag container according to FIG. 11 in an envelope according to FIGS. 15 to 19.
Figure 30:
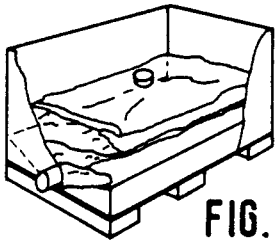
Figure 29:
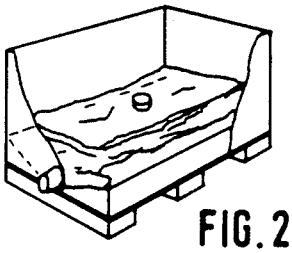
Figure 28:
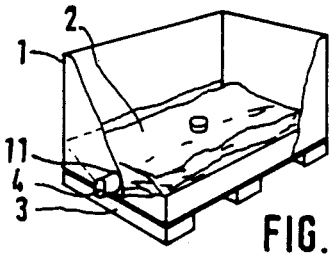

FIG. 23 shows an advantageous alternative for the manufacture of the shaping elements 165, with respectively two shaping elements 165 being punched from a cardboard piece 175. The form of the shaping elements is composed of an elongated rectangle 176 and four right triangles 177*a, b, c, d*. The right triangles extend at an acute angle toward the center line 178 where the triangles respectively lying on the same side of the rectangle 76, get into contact. The short-length leg of the right triangles is disposed at the side facing away from the center line 178, with the length of the short legs 179 corresponding to the length of the edge 181 of the elongated rectangle 176 extending beyond the hypotenuse 180 of the triangle. The solid lines in FIG. 23 correspond to the punching lines at which the shaping elements 165 are punched out; the dash-dotted lines refer to the folding edges, with the cardboard box at all folding edges with the exception of the center line 178, being moved vertically downward. Thereafter, the front portion will be so folded about the center line 178 that the long-length legs 182 and the transverse edge 183 of the elongated rectangle 176 stand upright on a common plane.

The shaping elements 165 can be locked in this shape by suitable means. However, it will be particularly advantageous to so fit the shaping elements into the inner cardboard box 160 as to cause them to be kept in that shape by a slight clamping effect within the inner cardboard box.

The acute angle between the long-length leg 182 and the hypotenuse 180 corresponds to the angle at which the foil bag is inclined toward the center of the outer cardboard box 150 to facilitate draining of the product to thereby attain a substantially complete discharge.

FIGS. 24 to 27 show a cross-sectional view of the unfolding of the foil bag to be preferred in the practice of the invention. FIGS. 28 to 31 are a perspective view of the same operation. FIGS. 24 to 27 illustrate the inner edges of the inner cardboard box 160. The bottom side shows the upper edge of the shaping elements 165 imparting to the foil bag the inclination desirable for the discharge. The charging orifice 187, for loading purposes, is connected to an apparatus (not shown) which automatically adapts to the height of the charging opening 187 varying during loading.

FIGS. 28 to 32 describe the same operation by a perspective view. The envelope 1 into which are inserted the shaping elements 160, is based on a pallet 3. The foil bag 2 is already in the proper initial position for loading, with the draining tongue 4 pierced through the port 11 and locked. FIGS. 24 to 27 illustrate, as do FIGS. 28 to 31, the mode in which the bag unfolds during loading in exactly predetermined manner, with the welding seam 135 which is the point critical of the strength of the foil bag, conforming already at an early date to the inner edge 185 of the inner cardboard box 160 thereby precluding the formation of hollow pockets liable to result in undesired overstretching or even in a destruction of the foil connected by the welding seam. The illustrations, moreover, show that the foil bag unfolds in the desired manner without requiring any additional measures. Owing to this "programmed unfolding" possible only as a result of the special shaping of the foil bag 2, the foil bag, during loading, need not permanently be drawn into the proper position by an operator.

Figure 32:
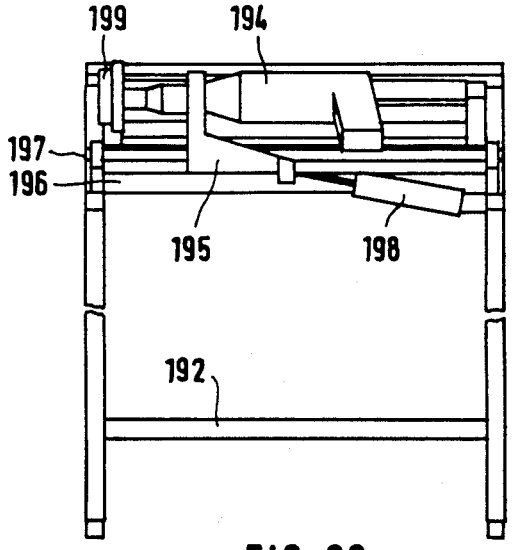
FIG. 32 is a simplified view of an apparatus for preparing the foil bag container according to FIGS. 10 to 22 in side view.
Figure 33:
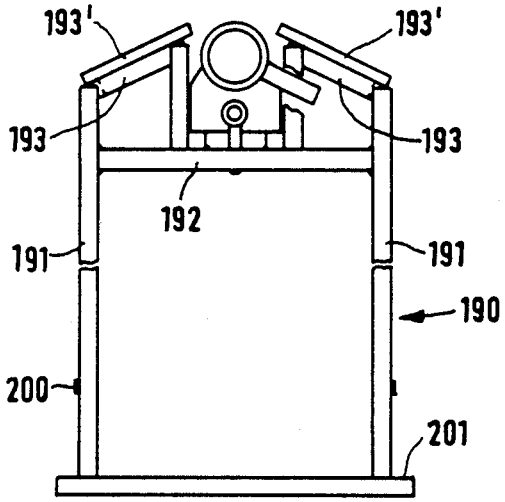
FIG. 33 is a front view of the apparatus for preparation according to FIG. 32.

FIGS. 32 and 33 show an apparatus for the preparation of the bulk container provided by the invention. The use of this apparatus facilitates the fixing together of the cardboard boxes and results in substantial reductions in the preparation time. It will have to be taken into consideration that the cardboard boxes which according to the preferred form of embodiment of the invention as shown form envelope 1, become rapidly unhandy with an increasing container size.

The apparatus 190 comprises a frame of perpendicular 191 and horizontal 192 wooden or steel rods. The upper part of the apparatus, in profile, exactly corresponds to the shape of the inner cardboard box 160 and of the shaping elements 165, as is best shown by the cross-sectional illustration according to FIG. 33, with the shaping elements being supported on the oblique frame parts 193 which, in inclination, exactly correspond to the angle of the shaping elements over the horizontal. The frame parts 193 are provided with a wooden plate 193' forming the support of the shaping edge. Apparatus 190 includes a boring machine 194 disposed in the frame in longitudinally movable manner. The movable support is effected by carriage 195 mounted to the slide rail 196 and guided through guide rod 197. The movement of carriage 195 is caused by feed cylinder 198. Provided at the front end of the boring machine is a keyhole saw 199 the diameter of which corresponds to the diameter of the draining tongue plus/minus a low tolerance. The apparatus 190, moreover, comprises a stop 200 for the internal cardboard box and a stop 201 for the external cardboard box.

For the preparation and for the discharge of the forms of embodiment of the invention to be preferred, the invention suggests the following ways of procedure:

The conception of the apparatus 190 enables the loader to assemble the bulk container himself. The envelope 1 and the foil bag with the draining tongue 4 and the loading opening 187 to be placed into the envelope, are supplied to the loader in decomposed, pre-folded condition, with the foil bag and the interior of the draining tongue 4 facing the product as well as the charging opening 187 being in sterile condition. The loader will then be able to assemble the bulk container within no time by using the apparatus 190 with tests having shown that an assembling time of 5 minutes is readily possible. The sequential steps for assembly are as follows: first the inner cardboard box is so put over the apparatus 190 as to cause the bottom bending flaps of the inner cardboard box to point to the top and the upper bending flaps to get into abutment with the stop 200 of the apparatus 190. Thereafter, the shaping elements 165 are placed upon the corresponding mounts 193. Subsequently, the outer cardboard 150 is placed upon the apparatus, with the upper bending flaps 151 being in abutting relationship with stop 201, bottom, of the apparatus 190. Afterwards, the reinforcing elements 155 are inserted between inner cardboard box and outer cardboard box while bending the bending flaps. By actuating the feed cylinder 198, the carriage with the boring machine disposed thereon is moved toward the internal cardboard box, cutting by the keyhole saw 199 the port 11 for the draining tongue through the three cardboard boxes, thereby safeguarding that the ports cut into the three cardboard boxes are in precisely mating relationship which would not be readily safeguarded if the openings were punched from the very beginning into the cardboard boxes. The so prepared envelope 1 will then be removed from the apparatus 190 and mounted in the proper position, i.e. with the bottom erected downwardly. For this purpose, it is appropriate to place the envelope 1 rightaway onto a pallet 3 as this will substantially facilitate the transport of the loaded bulk container. In this connection, especially also the strength of the cardboard box will have to be taken into consideration upon which not excessively high requirements are placed when using a pallet as would be the case if the bulk container were to be transported with no pallet.

After assembly of the envelope 1, the foil bag is placed into the envelope and the draining tongue is guided outwardly through the opening 11 and, by mounting the horse-shoe-type holding bracket 25 between the holding ribs 26 and 27 is locked. The foil bag is flatly spread on the bottom to enable loading of the bag as shown in FIGS. 23 to 31. Subsequently, the foil bag is charged by a sterile charging means which is known per se and thus not illustrated in any greater detail. Thanks to the conception of the foil bag as provided by the invention, charging is effected substantially automatically, with the charging apparatus comprising a control by way of which the apparatus is adapted to the varying height of the foil bag. After the loading having been completed, the charging opening is aseptically sealed whereafter the bulk container is ready for transportation. At the consumer end, the charging opening is connected to the apparatus for pressurizing the foil bag, and the discharge mechanism is mounted onto the draining tongue, with the discharge mechanism and the pressure supply, advantageously, being stored in a sterile solution. After mounting, the discharge mechanism will be connected with the circuit for rinsing the seals with an aseptical fluid and thereafter the discharge mechanism is rinsed with vapor, preferably hot vapor at a temperature of between 120° and 140° C., in the event that the product is heat resistant, or with a cold disinfecting solution in the event that the product is sensitive to heat, with the cold disinfecting solution being so selected that it changes the properties of the product as little as possible. After disinfecting of the interior of the discharge mechanism, discharge can be commenced and continued for weeks on end, with no bacteria penetrating the foil bag thereby preventing them from affecting the product quality.

I claim:

1. A bulk container for accommodating a fluidizable product, characterized in that a foil bag made of two foil webs welded together, one of the foil webs defining a bottom foil piece and the other foil web defining a top foil piece, the bottom and top foil pieces being of rectangular configuration and folded in parallel to an outer edge, the bottom foil piece including a pair lower outer folding edges, a pair of intermediate inner folding edges and a pair of upper lateral overstand portions which protrude beyond both the bottom piece outer and inner folding edges, the top foil piece including a pair of upper outer folding edges, a pair of intermediate inner folding edges and a pair of lower lateral overstand portions which protrude beyond the top piece inner and outer folding edges, the top and bottom piece overstand portions being (2) welded together is provided, which bag is disposed in a rigid envelope (1), with the foil bag (2) comprising a charging opening (187) and an outlet device provided in the lower part of the foil bag (2), with the outlet device extending through the envelope (1) and consisting of a draining tongue (4) rigidly connected to the foil bag (2) and a discharge mechanism (5) mountable thereon.

2. A bulk container according to claim 1, characterized in that, during discharge of the fluidizable product from the foil bag, sterile gas is applied to the interior of the foil bag (2), the pressure of the gas being above ambient pressure.

3. A bulk container according to either of claims 1 or 2, characterized in that the discharge mechanism (5) comprises a device (45,66;96) for piercing the foil bag or a closure plate (10) of the draining tongue (4).

4. A bulk container according to claim 3, characterized in that there is a sealing joint between at least the draining tongue and the discharge mechanism, the sealing joint being at least in part filled with an aseptical fluid.

5. A bulk container according to claim 3, characterized in that the envelope (1) is made of a plurality of nested cardboard boxes.

6. A bulk container according to claim 1, wherein when the foil bag is empty, the horizontal distance between the outer folding edge and the inner folding edge on one side of one of the top and bottom foil pieces is smaller by about one third than the horizontal distance between the pair of inner folding edges of said one of the top and bottom pieces, and the horizontal distance between the inner folding edge and the outer edge of the overstand portion on one side of one of the top or bottom pieces is slightly less than the horizontal distance between the pair of inner folding edges of said one of the top and bottom pieces.

7. A bulk container according to claim 1, wherein the discharge mechanism includes at least one sealing joint which is at least in part filled with an aseptical fluid.

8. A bulk container for accommodating a fluidizable product, the bulk container comprising:

a foil bag (2) formed by welding together individual foil webs (136, 140), said foil bag being disposed in a rigid envelope (1) and having a charging opening in the top part of the foil bag (187) and an outlet means disposed in the bottom part of the foil bag (2), said outlet means penetrating that envelope and including a draining tongue (4) rigidly connected to the foil bag (2) and adapted to be connected with a discharge mechanism (5), said draining tongue being integrally formed of plastic material and having a tubular body (20) with a substantially annular cross section and a flange (21) for being welded onto the foil bag, said draining tongue (4) having means for connecting the tongue (4) to the discharge mechanism (5), and said foil bag being composed of an upper foil web (140) and a lower foil web (136), both foil webs being of rectangular configuration and being welded together, said lower foil web (136) and said upper foil web (140) respectively comprising one pair of inner folding edges (138, 138') pointing inwardly and one pair of outer folding edges (137, 137') pointing outwardly and a pair of lateral overstand portions (141, 141') projecting beyond the folding edges, at which the foil webs are welded together.

9. A bulk container according to claim 8, wherein the bottom side of the foil bag (2) is supported on two acute angle sloping planes so that a chute having a longitudinal axis is formed, the longitudinal axis of the chute extends in parallel to one of the edges of the envelope (1) and substantially toward the draining tongue (4).

10. A bulk container according to claim 9, characterized in that the sloping planes are formed by shaping elements (165) that are punched from a sheet of cardboard and are folded.

11. A bulk container according to claim 10, characterized in that each of the shaping elements (165) consist of an elongated rectangle (176) which, laterally, is integrally formed with two pairs of right triangles (177*a, b, c, d*) extending at an acute angle toward the shorter of the center lines (178) of the rectangle, with the elongated rectangle extending by an amount beyond the hypotenuse (180) of each of the triangles as corresponds to the length of the side of each of the triangles (177*a, b, c, d*) facing away from the shorter of the center lines (178) of the elongated rectangle (176).

12. A bulk container according to claim 8 further comprising gas supply means (6, 7, 8, 9) which provide pressure above ambient pressure to the interior of the foil bag during discharge, said gas supply means being connected by a line (7) with the foil bag (2) by means of a pressure control device (8).

13. A bulk container according to claim 12, wherein the gas supply means comprises a gas bottle (6).

14. A method for preparing for product withdrawal from a bulk product container including a foil bag having an outlet device secured thereto and made up of a draining tongue and a discharge mechanism, characterized in that the draining tongue (4) is rigidly connected to the discharge mechanism (5), whereafter all parts getting into contact with the product, including substantially the interior areas of the draining tongue (4), the exterior of the foil bag or a closure plate (10) within the draining tongue and the interior of the discharge mechanism (5), are sterilized by a sterilizing fluid introduced into the discharge mechanism (5).

* * * * *

UNITED STATES PATENT AND TRADEMARK OFFICE

CERTIFICATE OF CORRECTION

PATENT NO. : 4,836,418

DATED : June 6, 1989

INVENTOR(S) : Wilfried Dinslage

It is certified that error appears in the above-identified patent and that said Letters Patent is hereby corrected as shown below:

Column 18, Claim 1, line 28, after "pair", insert --of--;

Column 19, Claim 8, line 16, change "that" to --the--.

Signed and Sealed this

Thirteenth Day of March, 1990

*Attest:*

JEFFREY M. SAMUELS

*Attesting Officer*

*Acting Commissioner of Patents and Trademarks*